United States Patent [19]

Gref et al.

[11] 4,276,853

[45] Jul. 7, 1981

[54] EXPERIMENTAL PLANT FOR THE COATING AND DRYING OF MATERIAL IN THE FORM OF WEBS

[75] Inventors: Hans Gref; Hans Hofmann, both of Cologne; Werner Zander, Leverkusen; Josef Busch, Bergisch-Gladbach, all of Fed. Rep. of Germany

[73] Assignee: AGFA-Gevaert, A.G., Leverkusen, Fed. Rep. of Germany

[21] Appl. No.: 3,701

[22] Filed: Jan. 15, 1979

[30] Foreign Application Priority Data

Jan. 19, 1978 [DE] Fed. Rep. of Germany ..... 2802184

[51] Int. Cl.[3] ..... B05C 3/172

[52] U.S. Cl. ..... 118/643; 118/67; 118/239; 118/419; 118/421; 118/423

[58] Field of Search ..... 118/67, 68, 239, 419, 118/421, 423, 641, 642, 643; 68/175

[56] References Cited

U.S. PATENT DOCUMENTS 3,643,627 2/1972 Killin et al. ..... 118/421

FOREIGN PATENT DOCUMENTS 1962089 5/1971 Fed. Rep. of Germany .
2246798 7/1977 Fed. Rep. of Germany .

OTHER PUBLICATIONS

Standard Handbook for Mechanical Engineers, 7th Ed., McGraw-Hill Book Company, N. Y. 1967, pp. 5–94.

*Primary Examiner*—Evan K. Lawrence
*Attorney, Agent, or Firm*—Connolly and Hutz

[57] ABSTRACT

The invention relates to an experimental plant for the coating and drying of material in the form of webs with viscous liquids. The flat loop of web including its guide elements is displaced over one or more fixed casting apparatus and coupled so that the web including the casting apparatus during coating is mounted to be free from vibrations.

11 Claims, 3 Drawing Figures

EXPERIMENTAL PLANT FOR THE COATING AND DRYING OF MATERIAL IN THE FORM OF WEBS

BACKGROUND OF THE INVENTION

This invention relates to an experimental plant for the single or multiple coating of webs of paper or foil with viscous solutions followed by drying. A plant of this type comprises at least one casting apparatus followed by a blow drier.

When designing a manufacturing plant, e.g. for the coating and drying of foils or boards, it is very important to know the optimum coating and drying conditions for producing the best quality product before the plant is designed.

It is also very valuable if a product which has been developed on laboratory scale can also be tested on a small scale for its behaviour under the expected manufacturing conditions and can be adjusted to these conditions. An exact knowledge of such data is all the more important the more the quality of the product or substance depends on the manufacturing conditions, e.g. the temperature during drying, the moisture, the quantity of air, etc. This applies to a particularly large extent to photographic products.

In German Auslegeschrift No. 1,962,089 there is described a multiple casting installation in which the supply of drying air is to a large extent variable. This installation is intended for production. It would be uneconomical to use it for experimental purposes on account of its size, but there is a limit to the extent to which its size can be reduced because a certain minimum length is required for the drying sections, so that even when reduced in size the installations are still relatively expensive.

An experimental casting machine for the single or multiple coating and drying of webs of paper or foil has been described in German Auslegeschrift No. 2,246,798. In this installation, the web of material moves in a loop and the individual casting apparatus with their stations are moved sideways towards the web to a position underneath the casting roller when they are to be used for casting, so that the supply and metering pipes which are necessary for modern coating processes must be moveable in order to move with the casting apparatus. This is a serious disadvantage, particularly when several casting apparatus are employed.

Moreover, in this experimental plant according to German Auslegeschrift No. 2,246,798, it is impossible to cover the web of material uniformly and completely with a blast of drying air in the region where the web is deflected over the casting roller. It is therefore impossible with this plant to achieve uninterrupted drying under specified conditions which enables one to draw conclusions applicable to the process carried out on a factory scale.

Another disadvantage of this installation is that constructional measures designed to eliminate harmful external influences (e.g. vibration of the building) which could interfere with the coating process, are difficult to carry out and then only at considerable expense. Although the whole machine could be mounted on vibration insulators, this would have the disadvantage that the resulting system, which would be insulated against the floor, would still contain within itself many potential sources of vibration (driving motors, metering devices, among others).

Another disadvantage which has shown up in practice is that if the web is moved over a drum of relatively large thermal capacity in controlled drying experiments, the result can be substantially affected by uncontrolled thermal effects from the reverse side.

Furthermore, when a web is moved along a path as shown in FIG. 1 of German Auslegeschrift No. 2,246,798, it is difficult to place the loop of web into position without damaging it, especially if it already contains sensitive layers and if for economical reasons the machine is operated by only one person.

Another disadvantage is that in order to ensure good contact with the casting roller, the web must be passed over a centre disc roll on the sensitive side of the material. It is found in practice that only relatively narrow webs can be treated in this way without deformation of the foil, especially if the foil is thin. Where it is necessary to use wider webs, for example for certain tests, this type of centre disc deflection cannot be employed. Replacement of the centre disc roll, for example by an air bearing or so-called "vacuum roller" would, however, require complicated technology and render the conducting of experiments more difficult.

In such an installation, the casting apparatus must be removed from the table for rinsing. The time required for this is in some cases too long to leave sufficient time to enable all the impurities to be thoroughly washed out of the casting apparatus (some modern photographic substances, e.g. instant hardener solutions, undergo very rapid chemical reactions).

Finally, it has been found in this installation that in the region of the deflecting drum it is impossible to carry out a controlled transfer of heat from the reverse side varying with time, e.g. by means of air blasts, as is often desired.

SUMMARY OF THE INVENTION

It is an object of the present invention to provide a simple and compact experimental plant which will not have the disadvantages mentioned above so that both the coating and drying conditions required on a production scale will be able to be simulated as completely as possible and the plant will be distinguished by its optimum construction, safety and ease of operation and the quality of the experimental results to be expected.

To solve this problem according to the invention, the web of material in the form of a flat loop, including its guide elements, is moved over one or more casting apparatus installed in fixed positions which are moved towards the web in a definite sequence for coating, and the loop of web which is to be coated is coupled to the casting apparatus during coating so that both the web and the casting apparatus are protected against vibration from the machine itself and from the room in which it is installed.

Furthermore, the loop of web is moved away immediately after it has been coated, and a portion of a nozzle channel is clamped into position in place of the casting apparatus so that the loop of web is completely covered by an air blast.

According to a particular advantageous embodiment, casting is immediately followed by automatic rinsing of the casting apparatus, which is made possible by the fact that the web has been moved away from the casting region.

In a preferred embodiment, the loop of web is dried from the reverse side by convection or radiation and the web supports guiding the movements of the web are designed so that there are no deflecting elements on the sensitive side of the web.

The plant according to the present invention has enabled all parameters which could affect the properties of the product, i.e. which determine the temperature/-time curve of the material and the drying speed, to be represented within narrow tolerances. The conditions of large manufacturing plants can therefore be simulated with sufficient accuracy and predictability. Furthermore, constructional and processing data (such as cost of wages, energy and material) which are essential for designing the large scale plants and avoid misplaced investments can be determined with great economy of time and cost with a plant according to the present invention.

In fact, the determination of such data is in many cases only possible by means of such a simulation plant since large scale plants of the required type are not available and the construction of such large plants for experimental purposes is unacceptable on account of the high experimental costs and costs of investment which this would entail.

Optimisation of processes to produce the best quality products would also be impossible to achieve by means of experiments on existing large scale plant because the cost entailed would be much too high, particularly when hundreds of variables of a process would have to be played through to optimise a complicated modern product.

Experts frequently doubt whether technical processes carried out on a very small scale can be used to determine data which would then be valid for large scale production. Experiments with plants according to the present invention have shown, however, that the accuracy of processed control in these plants is sufficient to produce very reliable results which can be applied to large scale production, both with regard to the physical parameters and with regard to the properties of the end products.

BRIEF DESCRIPTION OF THE DRAWINGS

A preferred embodiment of the invention will now be described with reference to the drawings, in which.

DESCRIPTION OF THE PREFERRED EMBODIMENTS

Figure 2:
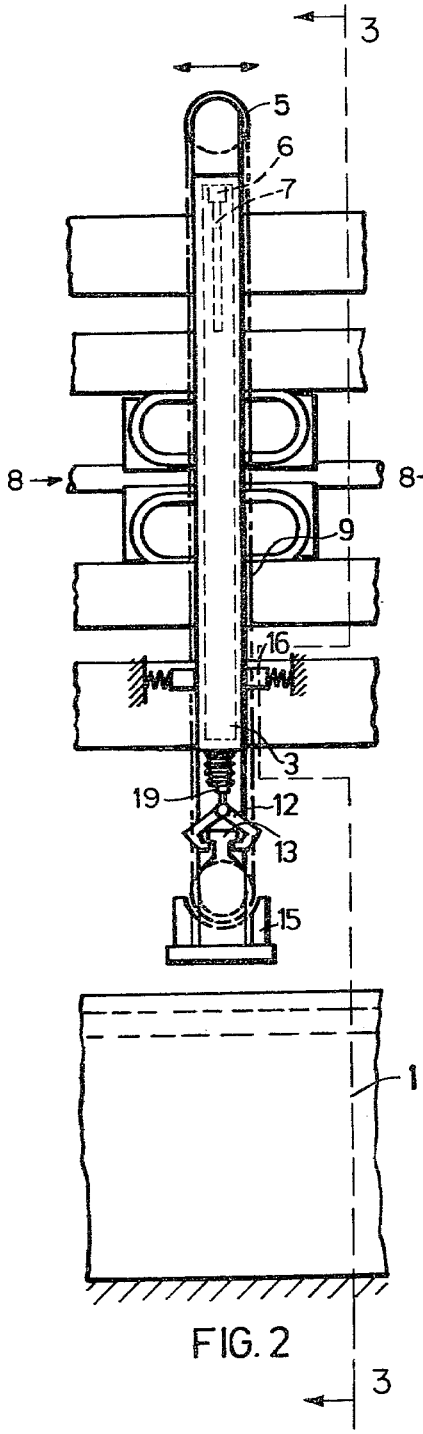
FIG. 2 is a front elevational view showing the arrangement of the web supporting and guiding elements and a casting apparatus.
Figure 3:
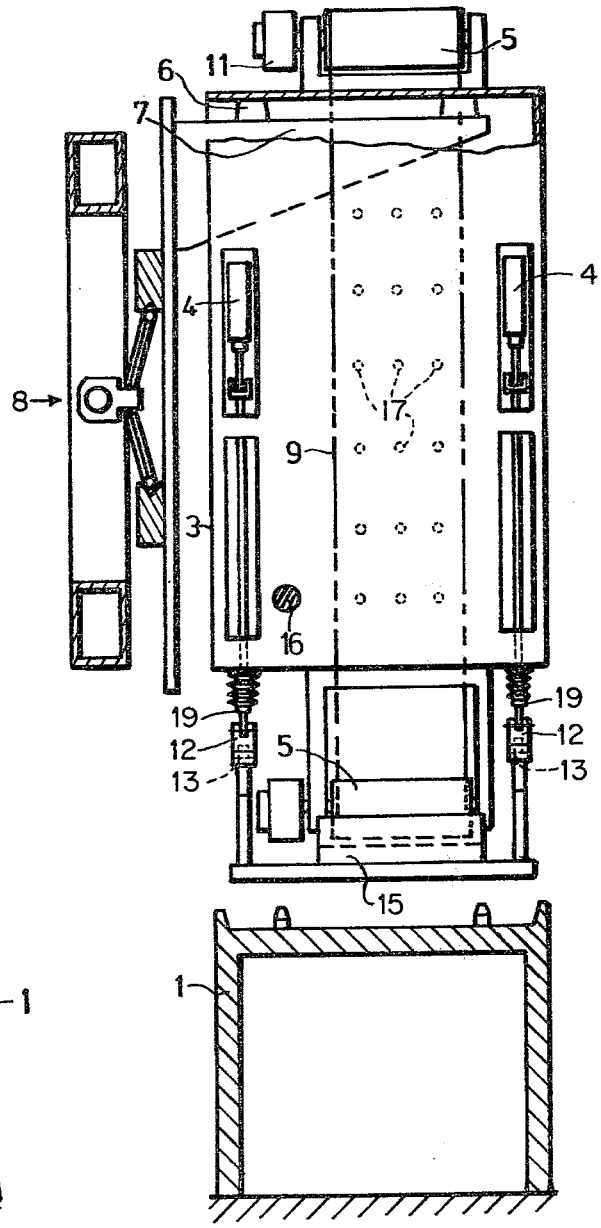
FIG. 3 is a left side elevational view of the arrangement shown in FIG. 2 with portions broken away and shown in cross section.

As can best be seen from FIGS. 2 and 3, the web 9 which is to be coated is moved over two(or more than two, e.g. arranged at the corners of a diamond) rollers 5 which are fixed to a support 3 having the form of a box. This box is secured to a bracket 7 by mounts 6 which is displaceable in the directions indicated by the arrow in FIG. 2. The web 9 is moved continuously by means of a motor drive 11 around the two rollers 5.

Figure 1:
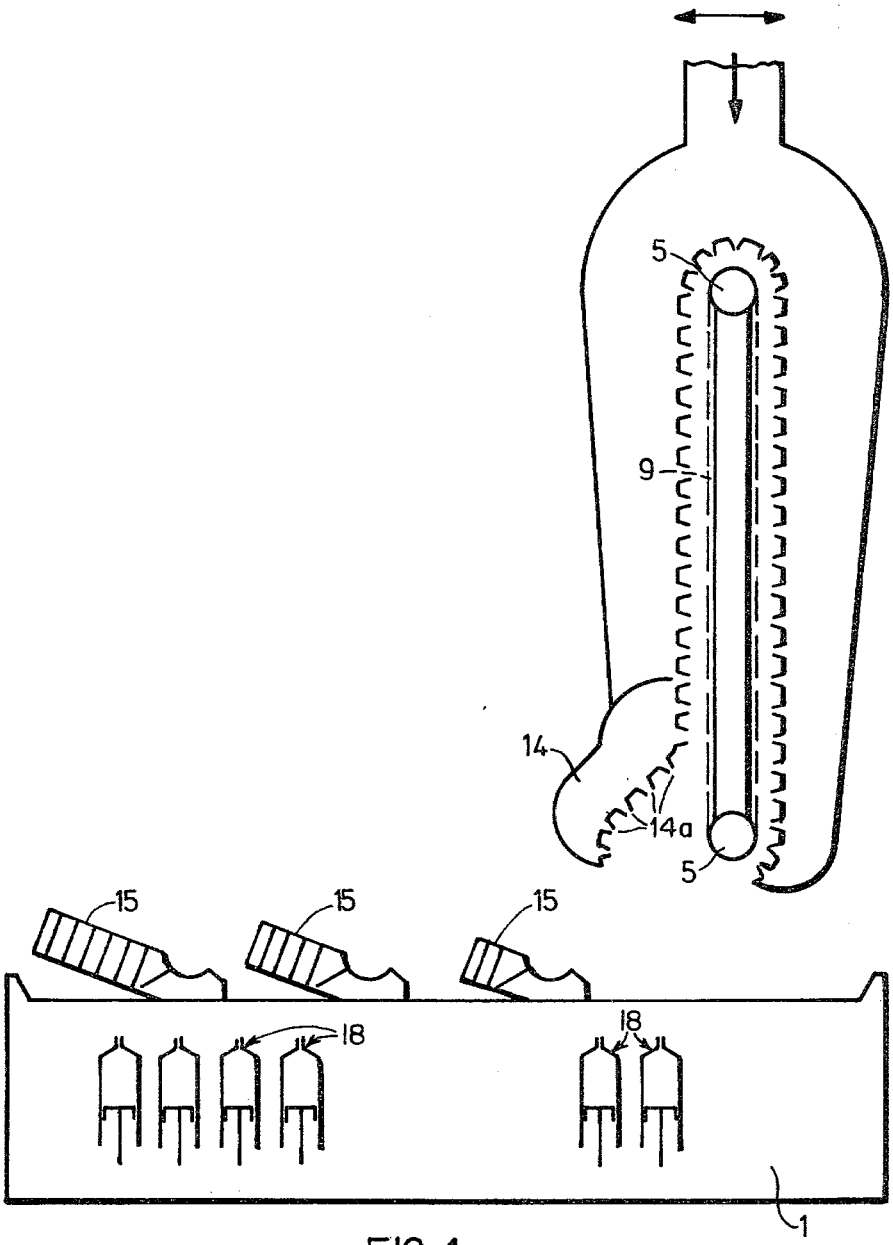
FIG. 1 is a schematic front view of an experimental plant in which a loop of web which is to be coated can be moved over several casting apparatus.

In much the same way as in a fixed bed milling machine, in which one or more workpieces are clamped in a fixed position and the milling head is moved over them, the casting table 1 and casting apparatus 15 on it are fixed and the loop of web 9 is moved by means of the movable support frame 8 for moving bracket 7 (shown by the arrows FIGS. 1, 2) over the casting apparatus. The energy supply lines and metering pipes 18 for the casting apparatus are therefore installed in fixed positions.

Servicing of this plant is simple, especially when operations must be carried out in the dark, since the casting apparatus remain in one position and can easily be found. Moreover, there is a saving in the amount of space required for this arrangement since the long table would require a room almost twice its length if it were transportable.

The casting apparatus could, of course, be arranged on a fixed circular table (not shown).

FIGS. 2 and 3 show gripper tongs 12 which can be moved sideways in relation to the supporting box 3 and which are moved downwards by means of raising and lowering cylinders 4 for casting apparatus 15, grip the casting apparatus by the gripping heads 13 provided for this purpose, and pull the apparatus towards adjustable limit stop 19 adjacent to the casting rollers. Exact positioning is achieved by means of the stops 19 which are adjustable to adapt the coating apparatus 15 to the thickness of the web to be coated. In order that the web may then be coated in an exactly defined sequence, the loop of web moves in a definite sequence over the individual casting apparatus. Each casting apparatus 15 is lowered immediately after it has been used for casting. The coated loop of web therefore becomes accessible all round, and a piece of nozzle channel 14 with nozzles 14*a* is clamped in the position where the casting apparatus was situated during coating. The web is thereby exposed to a blast of air all round its surface. Damping elements 6 are arranged between the movable bracket 7 and the supporting box 3 which carries the rollers. These damping elements 6 insulate the loop of web and the casting apparatus against vibrations from the machine and the workroom during the casting operation, i.e. when a casting apparatus 15 is lifted from the table 1 by the grippers 12. Elastic buffers 16 are also provided laterally (see FIG. 2) to prevent oscillation of the transport support due to accelerations when it is moved sideways.

In order to be able, if required, to apply heat to the web from the reverse side, the box 3 may be perforated 17 on the side facing the web so that air of a specified condition can be blown on the web through the apertures. In addition or alternatively, radiant heating elements may be arranged on the box to provide for heating of the web from the reverse side.

We claim:

1. An experimental plant for the of single or multiple coating of webs of paper or foil with viscous liquids, followed by drying, and subjected to vibration of machine and workroom, comprising at least one casting device for applying the liquid coating and a nozzle air drier with inertia free adjustability of the temperature and humidity parameters of the drying air, the experimental plant further comprising an elongated support means with guide elements for movably carrying an endless loop of web thereon past a said casting device, movable bracket means on the support means for disposing the support means and endless loop of web over one or more of said casting devices, means for individually moving a casting device into an operative position adjacent the endless loop for coating in a predetermined time sequence, detachable coupling means included in the support means for engaging a portion of the loop of the web which is to be coated to a casting device during the coating process, isolation means between the movable bracket means and the elongated support means for causing the casting device to be free from vibrations of the machine and workroom; and further characterized in that the nozzle drier is disposed about the loop of web, the nozzle drier is a channel having a removable nozzle channel portion for disposition about a portion of the loop immediately after it has been coated, and clamping means between the nozzle channel and the removable nozzle channel portion for clamping the removable nozzle channel portion into position as part of the nozzle channel in the place of a casting device so that the loop of web is completely covered by an air blast.

2. An experimental plant for the single or multiple coating and drying of webs according to claim 1, characterized in that rinsing means disposed adjacent to a casting device are provided for automatic rinsing of the casting device immediately after coating, damage to the web by rinsing water being prevented by means for immediate removal of the web from the casting device.

3. An experimental plant for the single or multiple coating and drying of webs according to claim 1, characterized by convection or radiation drying means disposed in operative relation to said support box for drying the inner side of the loop.

4. An experimental plant for the single or multiple coating and drying of webs according to claim 1 characterised in that the arrangement for guiding the web does not contain any deflecting elements facing the side of the web which is coated or to be coated.

5. An experimental plant for the single or multiple coating of webs of paper or foil with viscous liquids, followed by drying, and subjected to vibration of machine and workroom, comprising an extended table, a plurality of casting devices for applying the coating disposed upon the table, a vertically elongated support box, the support box having rollers disposed at upper and lower ends for movably carrying an endless loop about it, drying means on the surface of the box for removing moisture from an adjacent surface of the web, a support frame movably mounted adjacent the table for longitudinal and lateral movement above it, a bracket on the support frame and engageable with the support box for transporting the support box, grasping means on the bottom of the support box for grasping one of the casting devices at a time and engaging it with the web and roller at the lower end of the support box whereby the coating of the viscous liquid is applied to the lower roller and web from one of the casting devices, and damping means disposed between an upper surface of the bracket and the support box whereby the support box and connected elements are isolated from vibration of machine and workroom.

6. An experimental plant as set forth in claim 5, wherein the drying means in the box comprises perforations in the surface of the box adjacent the web.

7. An experimental plant as set forth in claim 5, wherein auxiliary elastic buffers are provided in the sides of the support box.

8. An experimental plant as set forth in claim 5, wherein said casting device includes enlarged head means and said grasping means includes gripping tongs for grasping the enlarged head means for said engaging of a casting device with the web.

9. An experimental plant as set forth in claim 5, wherein a nozzle channel conduit is disposed over the loop of web set forth in claim 6 for directing a flow of drying fluid at the web, the nozzle conduit having a removable lower section to permit a casting device to be engaged and disengaged with the lower roller.

10. An experimental plant as set forth in claim 9, wherein the removable lower section is fully closable about the lower roller in the absence of the casting device.

11. An experimental plant as set forth in claim 5, wherein the rinsing means is disposed adjacent the table for facilitating the rinsing of casting devices when removed from the lower roller.

* * * * *